US005417787A

United States Patent [19]

Tanaka

[11] Patent Number: 5,417,787

[45] Date of Patent: May 23, 1995

[54] TAPE WINDING DEVICE

[75] Inventor: Toshiharu Tanaka, Mie, Japan

[73] Assignee: Sumitomo Wiring Systems, Ltd., Mie, Japan

[21] Appl. No.: 127,617

[22] Filed: Sep. 28, 1993

Related U.S. Application Data

[62] Division of Ser. No. 795,340, Nov. 20, 1991, Pat. No. 5,271,791.

[30] Foreign Application Priority Data

Nov. 20, 1990 [JP] Japan ..... 2-318853
Nov. 20, 1990 [JP] Japan ..... 2-318854

[51] Int. Cl.[6] ..... H01B 13/00

[52] U.S. Cl. ..... 156/187; 156/195; 156/392; 53/588

[58] Field of Search ..... 156/468, 475, 486, 493, 156/432, 430, 184, 187, 195, 392; 53/137, 588, 589

[56] References Cited

U.S. PATENT DOCUMENTS

| | | | |
|---|---|---|---|
| 2,630,751 | 3/1953 | Cranston et al. | 53/588 |
| 3,031,368 | 4/1962 | Zent | 156/486 |
| 3,245,860 | 4/1966 | Aurich et al. | 156/486 |
| 3,547,737 | 12/1970 | Vici | 156/486 |
| 3,580,785 | 5/1971 | Mihalkanin | 156/475 |
| 4,264,398 | 4/1981 | Pruitt | 156/486 |
| 4,502,905 | 3/1985 | Jung et al. | 156/443 |
| 4,602,976 | 7/1986 | Fukuda et al. | 156/486 |
| 4,756,143 | 7/1988 | Lancaster | 53/588 |
| 4,790,896 | 12/1988 | Schmalhotz | 156/468 |
| 5,041,185 | 8/1991 | Ohashi et al. | 156/468 |

FOREIGN PATENT DOCUMENTS

| | | |
|---|---|---|
| 7321512 | 1/1974 | France . |
| 4032511 | 4/1992 | Germany . |

OTHER PUBLICATIONS

European Search Report (Feb. 9, 1993).

*Primary Examiner*—Mark A. Osele
*Attorney, Agent, or Firm*—Sughrue, Mion, Zinn, Macpeak & Seas

[57] ABSTRACT

A tape winding device having a rotating plate rotating around the circumference of a bundle of wires for a wiring harness or the like, and a driving device. A notched portion for insertion of a bundle of wires is formed in the rotating plate and the device main body, respectively, so as to extend from the outer edge to the rotating center thereof. A tape holder for holding a roll of adhesive-backed tape, and feeding and cutting devices for the tape are provided on the rotating plate. An arc-like collar is provided on the rotating plate concentrically with the rotating center thereof, and the driving device is constituted by a plurality of driving and guide rollers for sandwiching the collar. At least two pairs of the driving and guide rollers are disposed in the vicinity of each side of the notched portion. The feeding device has guide rollers supported on the rotating plate, and a feeding arm and a driving lever which are both supported on the rotating plate in a swiveling manner.

1 Claim, 14 Drawing Sheets

TAPE WINDING DEVICE

This is a divisional of application Ser. No. 07/795,340 filed Nov. 30, 1991, now U.S. Pat. No. 5,271,791 issued Dec. 21, 1993.

BACKGROUND OF THE INVENTION

1. Field of the Invention

The present invention relates to a handy-type tape winding device capable of automatically winding sheathing tape around a bundle of wires for a wiring harness or the like, and more particularly to a tape winding device exhibiting good workability especially when winding the tape around a branched portion.

2. Statement of the Prior Art

The official gazette of Japanese Patent Laid-Open (not examined) No. 117185/1989 discloses a handy-type tape winding device for winding sheathing tape around a bundle of wires for a wiring harness or the like.

A tape winding device of this type generally comprises a support portion for rotatably supporting a roll of adhesive-backed tape on a rotating plate adapted to rotate around the outer circumference of a bundle of wires for a wiring harness or the like, a feeding means comprising rollers for guiding the adhesive-backed tape fed out toward the bundle of wires, and a cutting means for cutting the tape on completion of the winding of the tape.

FIG. 14 is a front view of the tape winding device disclosed in the aforementioned official gazette. This tape winding device comprises a rotating plate 63 rotating around the circumference of a bundle of wires for a wiring harness or the like, and a device main body 61 having a driving means 62 for the rotating plate 63.

Notched portions 61*a*, 63*a* for receiving a bundle of wires are provided, respectively, in the rotating plate 63 and device main body 61 in such a manner as to extend from the outer edge to the rotating center thereof, and the rotating plate 63 is provided with a tape holder 64 for holding a roll of adhesive-backed tape, a feeding means 65 for feeding the adhesive-backed tape, and a cutting means (not shown) for the same tape.

Therefore, when the rotating plate 63 is rotated after a bundle of wires for a wiring harness or the like is inserted into the notched portions 61*a*, 63*a* with the leading portion of the tape being adhesively affixed to the bundle of wires, the tape is wound around the bundle of wires, and when the winding of the tape is completed, the tape is cut. The result is completion of a tape winding operation.

In a tape winding device of the above-mentioned type, however, in a case where there is a branched portion on a wiring harness, it is not possible for the branched portion to pass through the tape winding device due to the narrow notched portions 61*a*, 63*a*.

Due to this, every time a branched portion is encountered, the tape winding device has to be stopped to cut the tape and started again after the branched portion has passed therethrough, resulting in extremely bad operability.

With a view to solving this problem, it is possible to expand the notched portions 61*a*, 63*a* provided, respectively, in the rotating plate 63 and device main body 61 through up to about 180° around the portion for receiving a bundle of wires. This makes it possible for a branched portion to easily pass through the tape winding device only by slightly tilting the device. In contrast, however, there is produced difficulty in driving and supporting the rotating plate.

As described above, in this tape winding device, when the rotating plate is rotated after the leading portion of an adhesive-backed tape is adhesively affixed to a bundle of wires, the adhesive-backed tape is automatically wound around the bundle of wires, and when the winding of the tape is completed, the rotating plate is stopped to cut the adhesive-backed tape, completing a tape winding operation.

However, when the tape winding device is started again to winding the tape, the operator has to manually affix the leading portion of the tape to the bundle of wires, and this type of work is very laborious and deteriorates the working efficiency.

FIGS. 15A to 15C show the tape winding operation inherent in a conventional tape winding device. As shown in the drawings, in the tape winding device in which an adhesive-backed tape 51 extending over a curved portion 50 is pressed against a bundle of wires 60 (FIGS. 15A, 15B), although there is no need to manually affix the tape to the bundle of wires, since the leading portion of the tape 51 is not supported, the angle at which the tape is pressed against the bundle of wires 60 is limited, and for example, as shown in FIG. 15C, it is not possible to affix the tape to the bundle of wires from thereabove.

SUMMARY OF THE INVENTION

An object of the present invention is to improve the operability of a tape winding device by expanding notched portions through improving the rotating plate and the driving means therefor.

Another object of the present invention is to improve a tape winding device so that a tape winding operation is carried out without the operator's touching the tape during a series of winding operations from an initial tape winding operation to a final tape cutting one, and at any angle relative to the bundle of wires.

In order to accomplish the first object, the present invention provides a tape winding device of the above-mentioned type in which an arc-like collar is provided on the rotating plate, concentrically with the rotating center of the plate. The driving means is constituted by a plurality of driving and guide rollers that are adapted to sandwich the collar, and at least two pairs of driving and guide rollers are disposed, respectively, in the vicinity of each side of the opening portion of the notched portion with the collar being sandwiched by means of the remaining driving and guide rollers in the vicinity of the two pairs of driving and guide rollers.

In addition, a line of projection is formed around the full circumference of the collar, and a groove is formed around the full circumference of each guide roller so that the projection of the collar fits thereinto, whereby the decrease in the supporting stability of the rotating plate caused by expansion of the notched portions can be compensated for.

In the tape winding device as constructed above, the collar provided on the rotating plate is designed to be sandwiched at two points by means of the driving and guide rollers in the vicinity of at least one side of the opening portion of the notched portion.

Consequently, the rotating track of the rotating plate is defined. Moreover, the rotating plate rotates as the driving rollers rotate, and even if the notched portions are expanded to some extent, the rotating plate is prevented from coming off the device main body.

In order to accomplish the second object, the present invention provides a tape winding device in which a support portion for rotatably supporting a roll of adhesive-backed tape and a feeding means for feeding the adhesive-backed tape are provided on a rotating plate adapted to rotate around the circumference of a body such as a wiring harness around which the tape is wound. The feeding means comprises guide rollers supported on the rotating plate, and a feeding arm and a driving lever which are supported on the rotating plate in a swiveling fashion. The feeding arm is long enough to be brought into contact with the body around which an adhesive-backed tape is wound, and a support pin is provided on the arm in the vicinity of the swiveling fulcrum point, while a projection is provided on the leading portion thereof. The support pin is designed to penetrate through an adhesive-backed tape led thereto via the guide rollers from the non-adhesive side of the tape. The projection is situated on the non-adhesive side of the adhesive-backed tape between the support pin and the guide roller, and a gear is provided between the feeding arm and the driving lever for interlocking them each other. In accordance with the operation of the driving lever, the gear is designed to rotate the feeding arm so as to locate the arm on the adhesive-side of the adhesive-backed tape to thereby be led to the body around which a tape is to be wound. A spring is provided between the feeding arm and the rotating plate for biasing the feeding arm toward the non-adhesive side of the adhesive-backed tape.

In addition, an adhesive-backed tape cutting means may be provided on the above tape winding device. The cutting means comprises a cutter arm, a return lever, and a lock lever which are all supported on the rotating plate in a swiveling manner. The cutter arm is provided with a cutting blade at the distal end thereof, and has enough length for cutting the adhesive-backed tape extending between the body around which the tape is being wound and the support pin. A locking projection is provided on the lock lever. A gear is provided between the cutter arm and the return lever for interlocking them to each other. The gear is designed to move the cutter arm from the cutting position to the non-cutting position by operating the return lever. A cam is formed on the gear for holding the cutter arm at the non-cutting position by being brought into engagement with the locking position of the lock lever. A spring is provided between the cutter arm and the rotating plate for biasing the cutter arm toward the cutting position. A spring is provided between the lock lever and the rotating plate for biasing the lock lever toward a position where the locking projection and the cam are brought into engagement with each other.

A method of winding sheathing tape around a wiring harness or the like comprises the steps of first pulling out the leading end of an adhesive-backed tape that is rolled on the rotating plate adapted to rotate around the periphery of a body around which a tape is to be wound, such as a wiring harness, leading the tape so pulled out to the feeding arm supported on the rotating plate via the guide rollers, and causing the support pin provided in the vicinity of the fulcrum point of the feeding arm to penetrate through the leading end of the tape for support of the same tape.

The method further comprises the steps of rotating the feeding arm so as to catch the tape at the projection provided at the distal end thereof, pressing the tape extending between the projection and the support pin against the outer circumference of a wiring harness or the like for adhesive affixture thereon, thereafter returning the feeding arm so as to release the support pin from the leading end of the tape, and rotating the rotating plate for winding the tape around the wiring harness or the like.

The method is completed with the step of stopping the rotating plate so as to cut the adhesive-backed tape between the support pin and the wiring harness or the like with the cutter arm supported on the rotating plate, whereby the resultant leading end portion of the tape so cut that is situated on the device side is automatically put through the support pin.

In the tape winding device constructed as described above, an adhesive-backed tape is fed out of a rolled state via the guide rollers, and the leading end portion of the adhesive-backed tape is put through the support pin of the feeding arm from the non-adhesive side for support. Next, when the driving lever is operated, the feeding arm accordingly rotates so as to lead the tape to the body around which a tape is to be wound. At this time, the projection of the feeding arm catches the adhesive-backed tape between the guide roller and the support pin, and presses the adhesive-backed tape between the support pin and itself against the outer surface of the body around which a tape is to be wound for affixing the same tape thereon.

When the driving lever is then released, the driving lever is restored to its initial position by virtue of the biasing force of the spring, and in synchronism with this, the support pin being removed from the adhesive-backed tape, the feeding arm is also restored to its initial position.

When the rotating plate is rotated in this state, the adhesive-backed tape is wound around the body around which a tape is to be wound while being fed out in a natural manner. When the winding of the tape is then completed, the rotating plate is stopped, and the engagement between the locking projection and the cam is released by operating the lock lever. The cutter arm then rotates by virtue of the biasing force of the spring so as to cut the adhesive-backed tape between the body around which a tape is to be wound and the support pin. At this time, the adhesive-backed tape is pressed by means of the cutting blade, whereby the leading end of the adhesive-backed tape situated on the device side is put through the support pin. Finally, when the cutter arm is restored to the non-cutting position by operating the return lever, the locking projection of the lock lever is brought into engagement with the cam, and the tape winding device is restored to this initial state while maintaining such an engagement state.

DETAILED DESCRIPTION OF THE PREFERRED EMBODIMENTS

Embodiments of the present invention will now be described with reference to the accompanying drawings.

Figure 1:
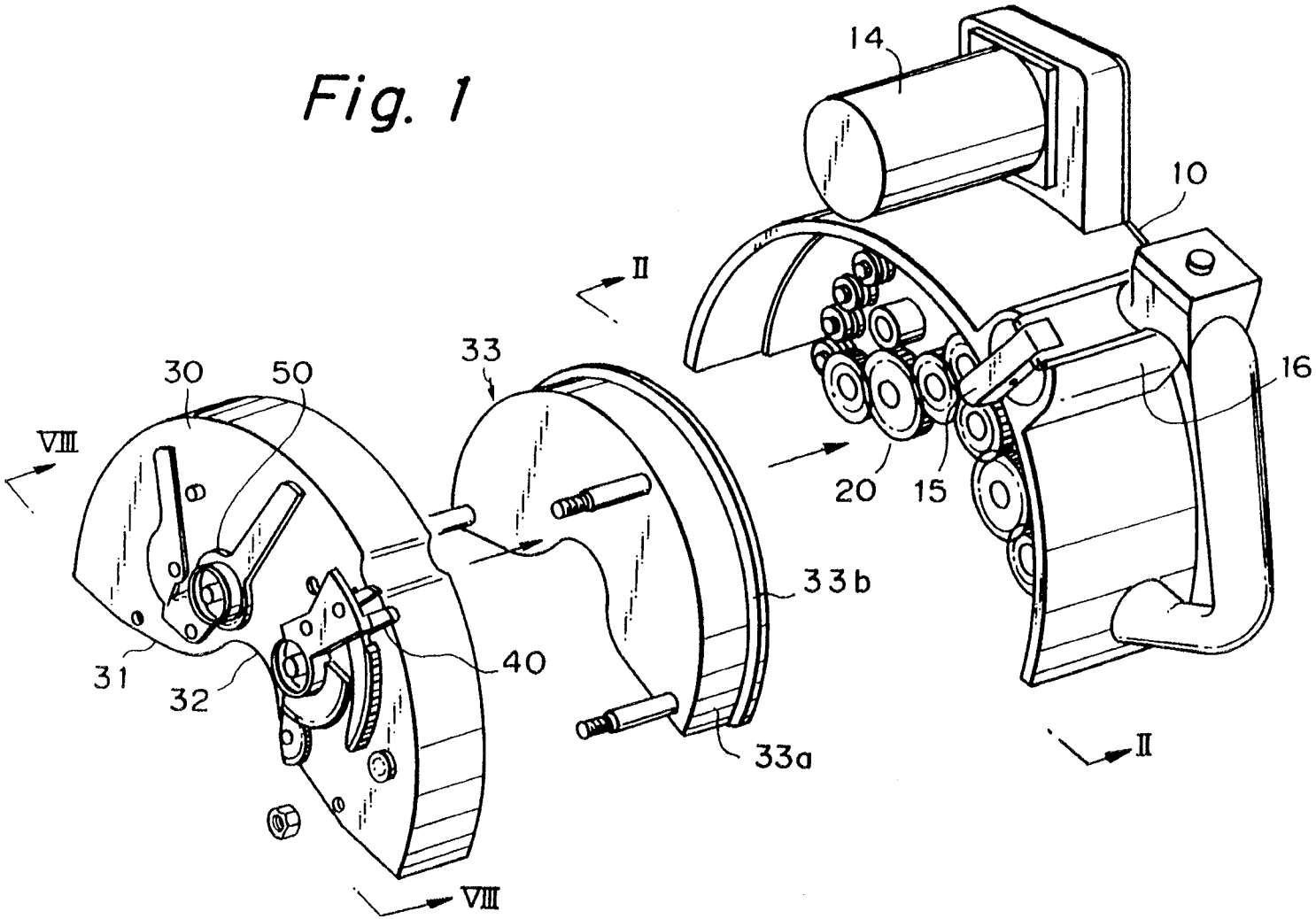
FIG. 1 is an exploded perspective view showing one embodiment of a tape winding device according to the present invention.

As shown in FIG. 1, a tape winding device of the present invention comprises a rotating plate 30 adapted to rotate around a bundle of wires for a wiring harness or the like, and a device main body 10 having a driving means 20 for the rotating plate 30.

The rotating plate 30 comprises a disc provided with a notched portion 31 having a central angle of about 150°, and in the central portion thereof a recessed portion 32 is formed in a radial direction so as to receive a bundle of wires when it is inserted thereinto.

Provided on this rotating plate 30 are a tape holder (not shown) for holding a roll of adhesive-backed tape, a feeding means 40 for the adhesive-backed tape, and a cutting means 50 for the same tape.

In addition, releasably provided on the rotating plate 30 is an arc-like support member 33 that is concentric with the rotating center of the rotating plate and which has a collar 33*a*.

Figure 2:
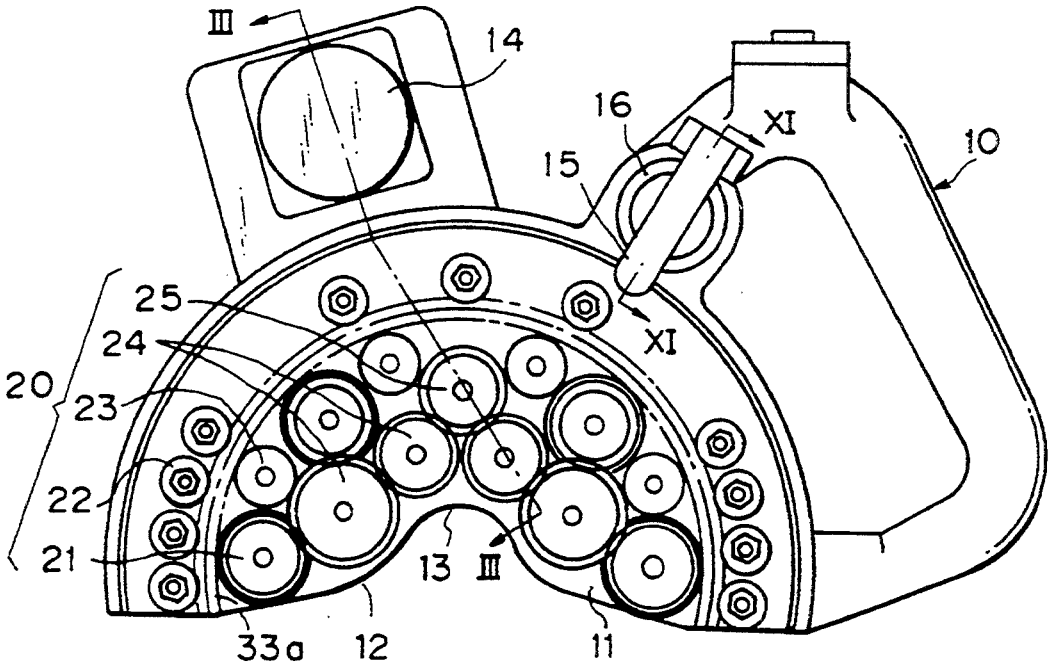
FIG. 2 is a front view as seen from the line II—II of FIG. 1.

As shown in FIG. 2, in the device main body 10, a plurality of driving rollers 21 and guide rollers 22, 23 functioning as driving means 20 are provided on a side plate 11 that is formed into substantially the same shape as that of the rotating plate 30 and which has, as in the case of the rotating plate 30, a notched portion 12 and a recessed portion 13 for receiving a bundle of wires.

These driving rollers 21 and guide rollers 22, 23 are provided concentrically with the rotating center of the rotating plate 30, and the collar 33*a* of the support member 33 is sandwiched between the driving roller 21 and guide roller 23 and the guide rollers 22 for rotation of the rotating plate 30.

Figure 6:
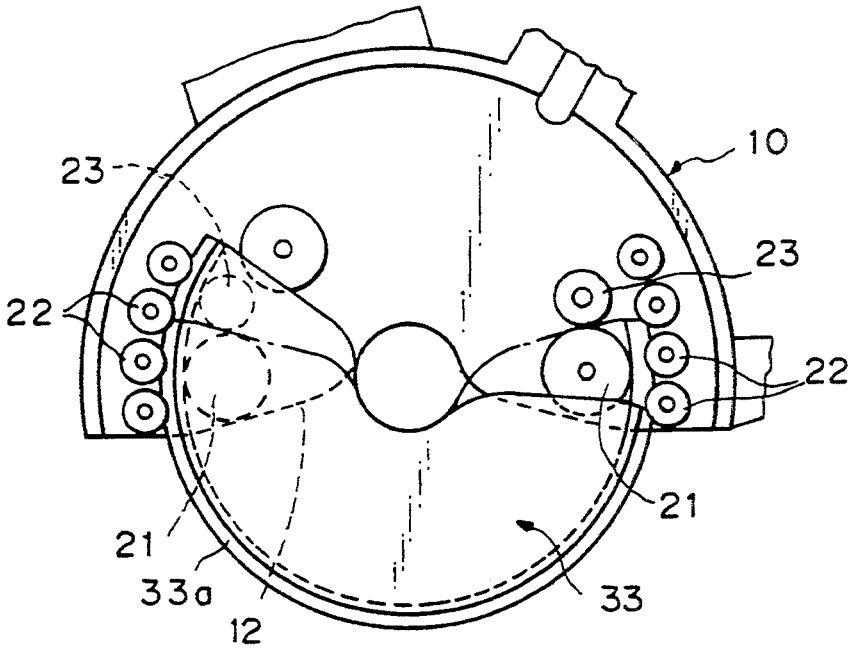
FIG. 6 is a front view showing a relationship between a rotating plate and a driving means.

In particular, a driving roller 21, a guide roller 23, and four guide rollers 22 are disposed on each side of the opening portion of the notched portion 12. As shown in FIG. 6, even when the rotating plate 30 rotates to the opposite side of the notched portion 12, since the collar 33*a* is supported at two positions, the rotating plate 30 is prevented from coming off the device main body 10.

Figure 3:
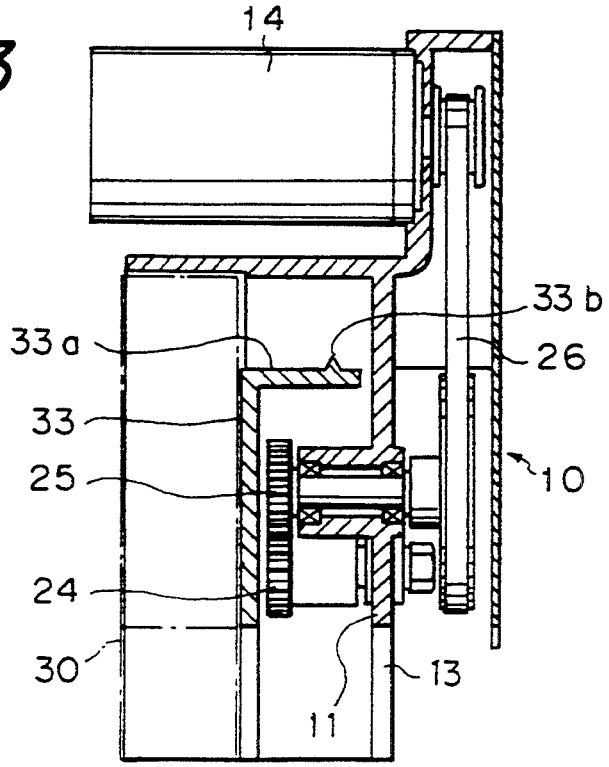
FIG. 3 is a longitudinal cross-sectional view taken along the line III—III of FIG. 2.

As shown in FIGS. 2 and 3, the driving roller 21 is interlocked via a gear 24 with a driving gear 25 driven by means of a motor 14 via a belt 26, and a rubber sheet is wound around the full circumference of the driving roller 21.

Figure 4:
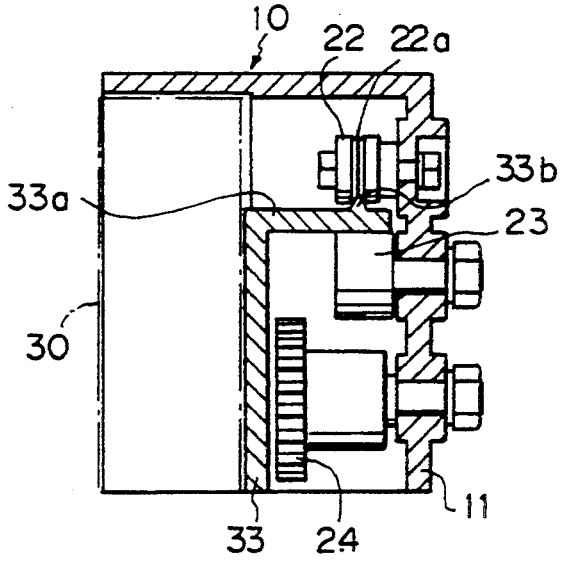
FIG. 4 is a partially cross-sectional view, similar to FIG. 3, showing another portion of the device.
Figure 5:
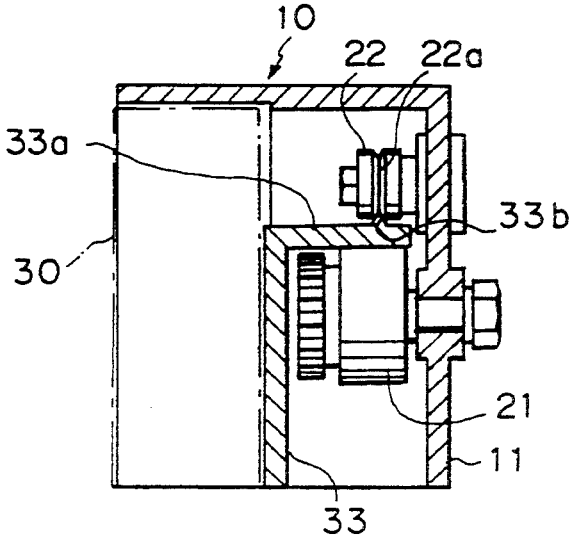
FIG. 5 is a partially cross-sectional view, similar to FIG. 3, showing a further portion of the device.

As shown in FIGS. 3 to 5, a line of projection 33*b*, triangular in cross-section, is provided around the collar 33*a*, and a groove 22*a* is formed around the full circumference of each guide roller 22 so that the projection 33*b* fits thereinto. Due to this, there is no looseness between the respective rollers 21, 22, 23 and the collar 33*a*, resulting in smooth and efficient rotations.

Figure 8:
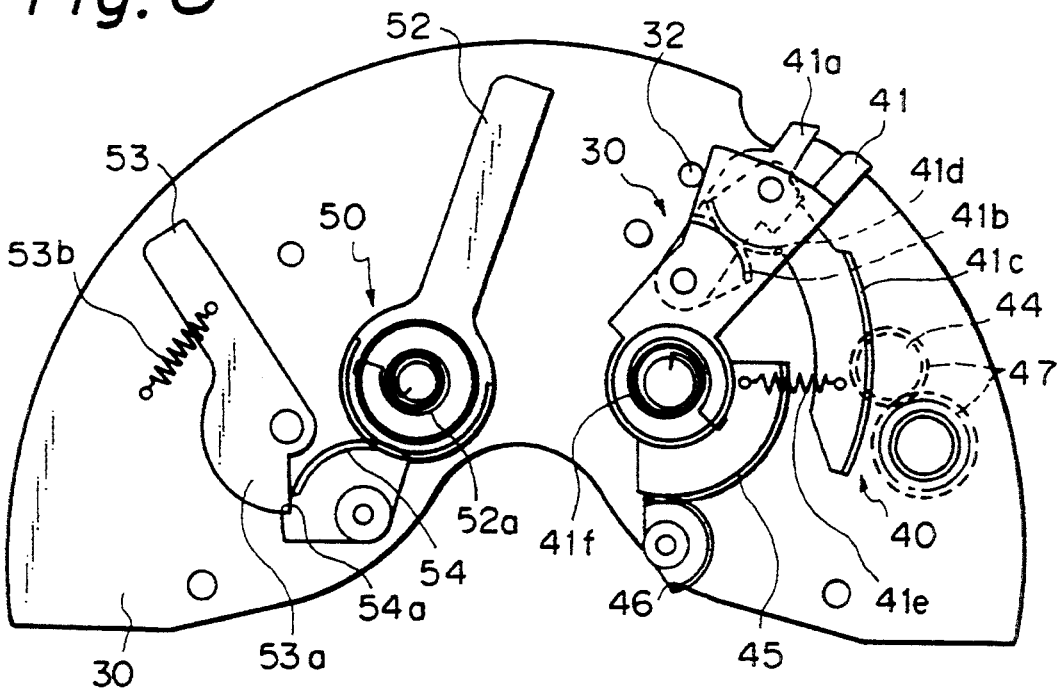
FIG. 8 is a front view of the rotating plate as seen from the line VIII—VIII of FIG. 1.
Figure 9:
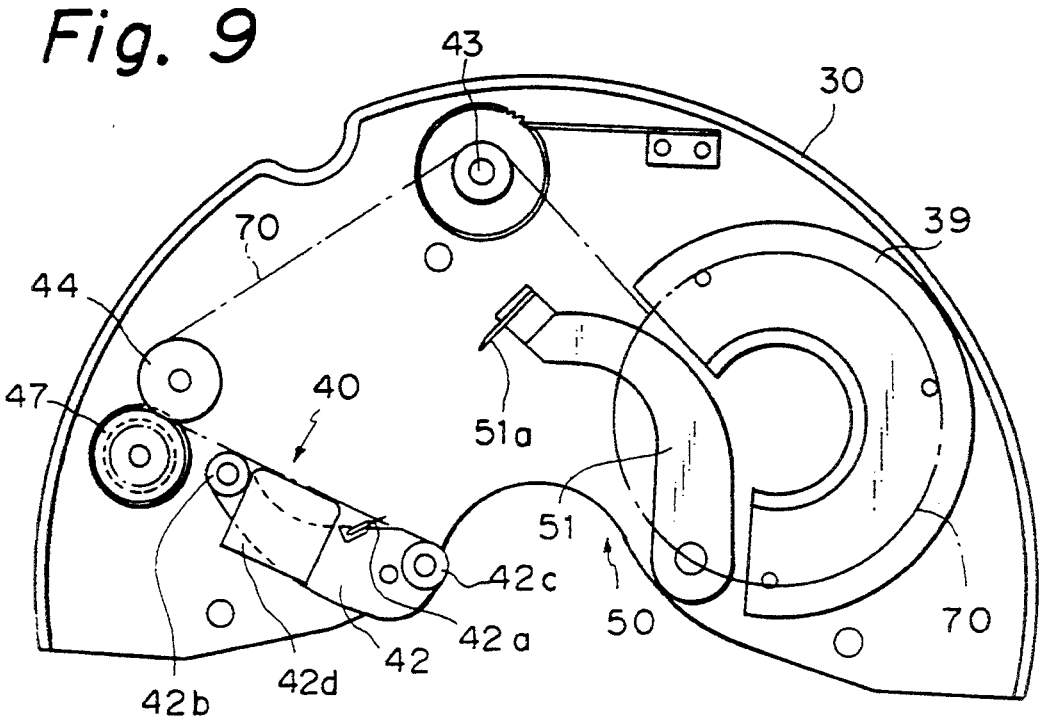
FIG. 9 is a rear view of FIG. 8.
Figure 10:
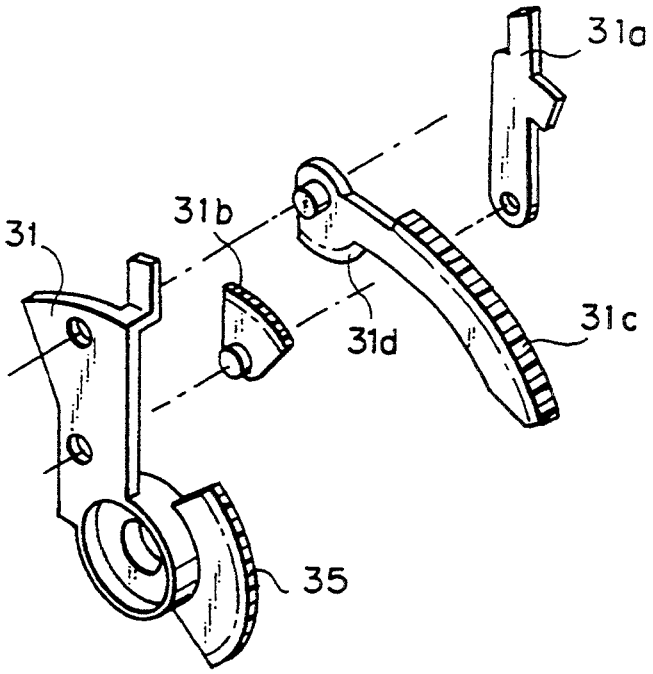
FIG. 10 is an exploded perspective view of a driving lever.
Figure 11:
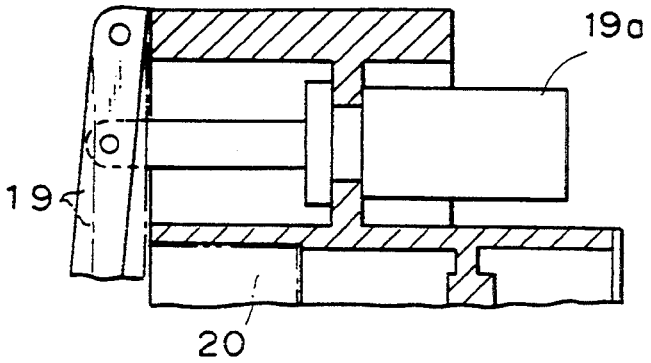
FIG. 11 is a longitudinal cross-sectional view taken along the line XI—XI of FIG. 2, FIGS. 12A to 12G are explanatory views showing the operations of another embodiment of the tape winding device of the present invention.

As shown in FIGS. 8 and 9, the feeding means 40 comprises a driving lever 41, a feeding arm 42, and guide rollers 43, 44, which are all supported on the rotating plate 30.

The feeding arm 42 is connected to the driving lever 41 via interlocking gears 45, 46, and is rotated to be led to a bundle of wires for a wiring harness or the like by operating the driving lever 41. In addition, provided on this feeding arm 42 is a support pin 42*a* for supporting an adhesive-backed tape fed through the guide rollers 43, 44 by penetrating through the leading portion of the adhesive-backed tape from the non-adhesive side thereof. Provided on the ends of the arm are projections 42*b*, 42*c* that are situated on the non-adhesive side of the adhesive-backed tape. In addition, a sponge 42*d* is provided between the support pin 42*a* and the projection 42*b* for pressing the adhesive-backed tape situated therebetween against a bundle of wires for a wiring harness or the like.

A set lever 41*a* and a set gear 41*b* adapted to move integrally with the set lever 41*a* are supported on the driving lever 41 in a swiveling fashion, and also provided thereon in a swiveling fashion is a driving gear 41*c* for the guide roller having an interlocking gear 41*d* that is brought into mesh engagement with the set gear 41*b*. Although the driving gear 41*c* is designed to rotate the guide roller 44 when it is brought into mesh engagement with an interlocking gear 47, the driving gear is biased by means of a coil spring 41*e* interposed between the driving lever 41 and itself toward a position where it is prevented from being brought into mesh engagement with the interlocking gear 47.

The driving lever 41 urges the feeding arm 42 by means of a spiral spring 41*f* provided a supporting shaft and itself toward a position where the projection 42*b* does not come into contact with an adhesive-backed tape, and is retained at an initial position by means of a stopper pin 32 provided on the rotating plate 30.

As shown in FIGS. 8 and 9, the cutting means 50 comprises a cutter arm 51, a return lever 52, and lock lever 53, which are all provided on the rotating plate 30 in a swiveling fashion.

The cutter arm 51 has a cutting blade 51*a* provided on the leading end thereof, and when the cutter arm 51 rotates, the cutting blade 51*a* is put between the support pin 42*a* and the projection 42*c* of the feeding arm 42 to thereby cut an adhesive-backed tape.

An interlock gear 54 is provided on the cutter arm 51 at a position between the cutter arm 51 and the return lever 52, and a cam 54*a* is provided on this interlock gear 54 for engagement with a locking projection 53*a* provided on the lock lever 53.

A spiral spring 52*a* is provided on the return lever 52 at a position between the return lever 52 and a supporting shaft thereof so as to bias the cutter arm 51 toward a position where an adhesive-backed tape is to be cut. Furthermore, a coil spring 53*b* is provided on the lock lever 53 at a position between the lock lever 53 and the rotating plate 30, and the lock lever 53 is biased toward a position where the locking projection 53*a* thereof is brought into engagement with the cam 54*a*.

Biasing means provided on the driving lever 41 and return lever 52 are not limited to the spiral spring exemplified above, and biasing can be effected, for example, by means of a coil spring (not shown) provide directly between the feeding arm 42 and cutter arm 51 and the rotating plate 30.

As shown in FIGS. 1 and 2, a lever 15 is provided on the device main body 10 which is designed to move closer to and/or withdraw from the rotating plate 30 by means of a solenoid 16, and when the lever 15 approaches the rotating plate 30, the lever comes into engagement with the respective levers 41, 41*a*, 52, and 53 provided on the rotating plate 30 to thereby move them, respectively.

In this tape winding device, since the driving means 20 described above is employed, it is possible to increase the central angle of the notched portions 31, 12 provided, respectively, in the rotating plate 30 and the side plate 11 of the device main body 10 to around 150° as described above.

Figure 7:
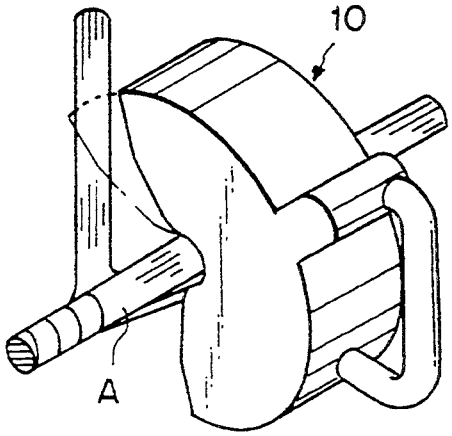
FIG. 7 is a perspective view showing an application of the tape winding device of the present invention.

Due to this construction, when winding a branched portion of a bundle of wires, it is possible to easily pass through a branched portion of a bundle of wires A only by tilting the device main body 10 of the tape winding device as shown in FIG. 7, and this obviates the necessity of carrying out conventional time-consuming work of cutting and rewinding an adhesive-backed tape every time a branched portion is encountered.

Referring to FIGS. 12 and 13, a series of operations of the tape winding device starting from the winding of a tape and finishing with the cutting of the same will now be described in a sequential manner. FIGS. 13A to 13G are perspective views showing, respectively, the rear sides of FIGS. 12A to 12G, and for the sake of convenience in description, reference is made only to A, B, C . . . G, which are common to FIGS. 12 and 13.

First, as shown in FIG. 9, a roll of adhesive-backed tape 70 is mounted-on a tape holder in advance. The tape 70 is fed in such a manner as to be brought into contact with the guide rollers 43, 44 on the adhesive side thereof, and the leading end thereof is put through the support pin 42*a* of the feeding arm 42 for support.

Figure 12A:
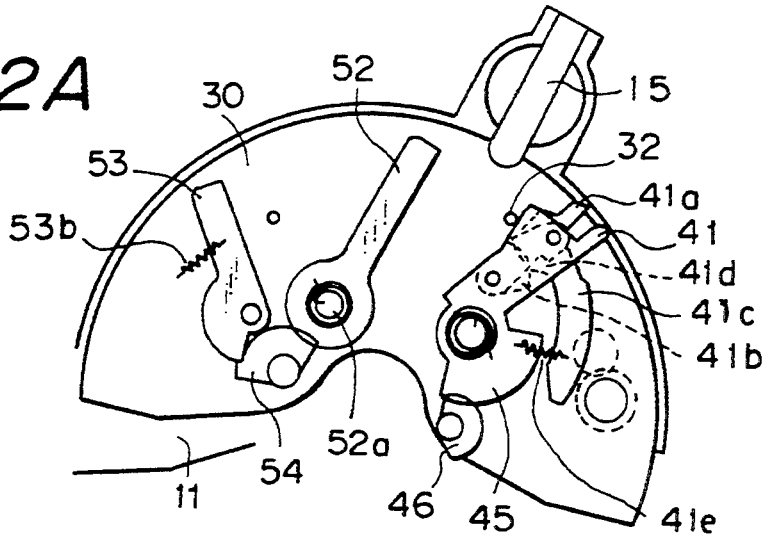
Figure 12B:
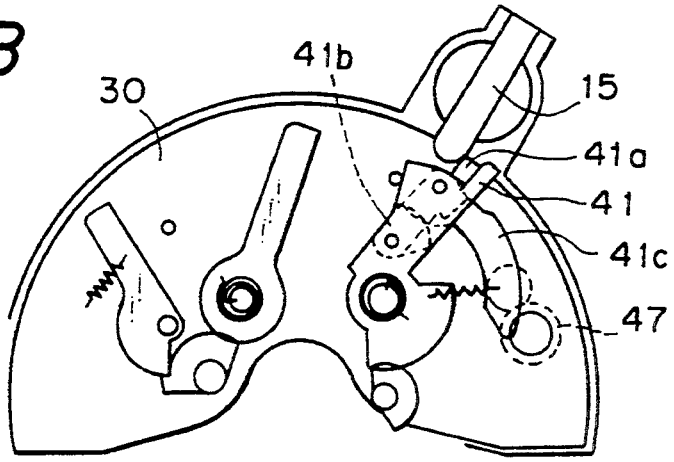
Figure 12C:
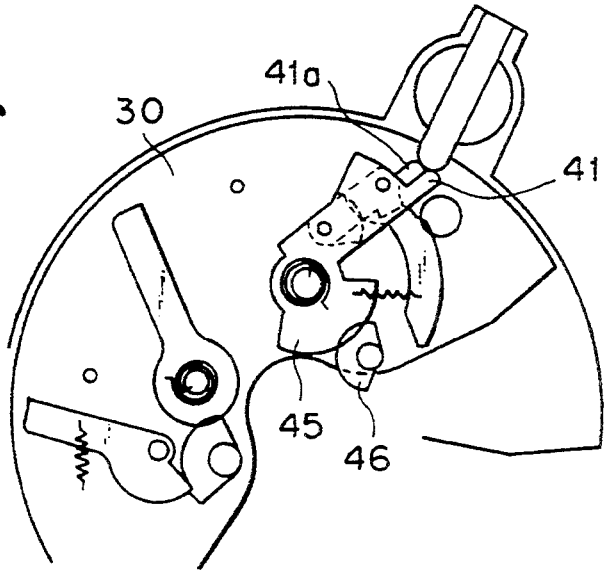
Figure 12D:
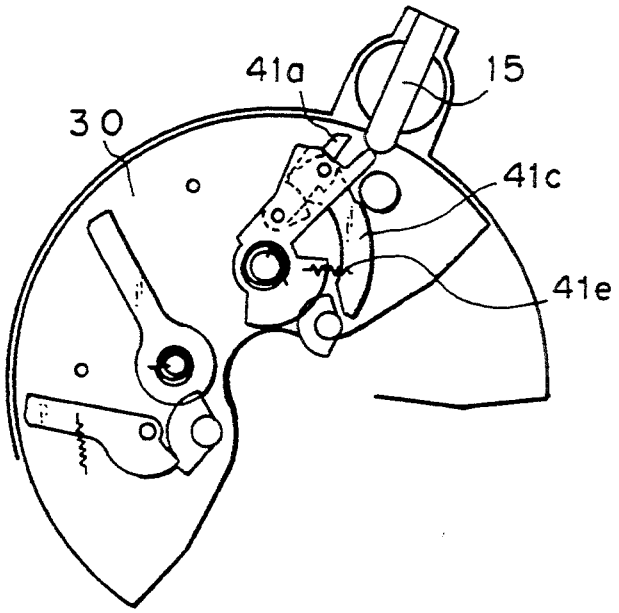
Figure 12E:
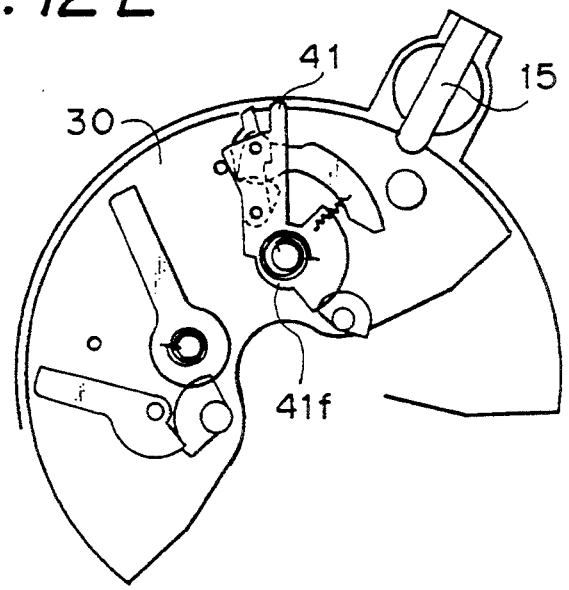
Figure 12F:
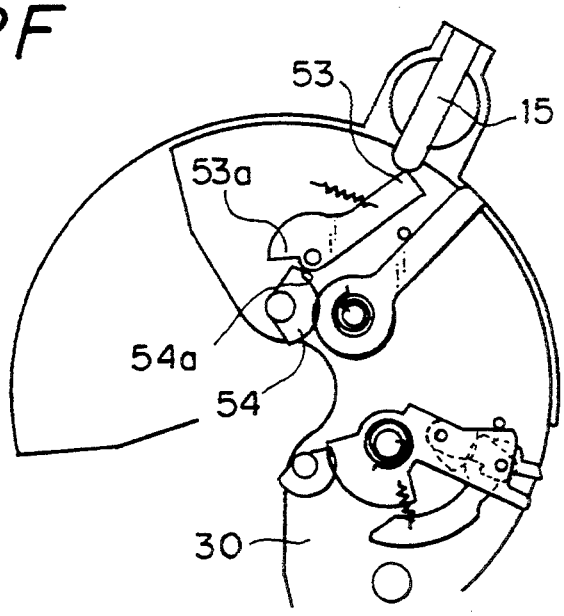
Figure 12G:
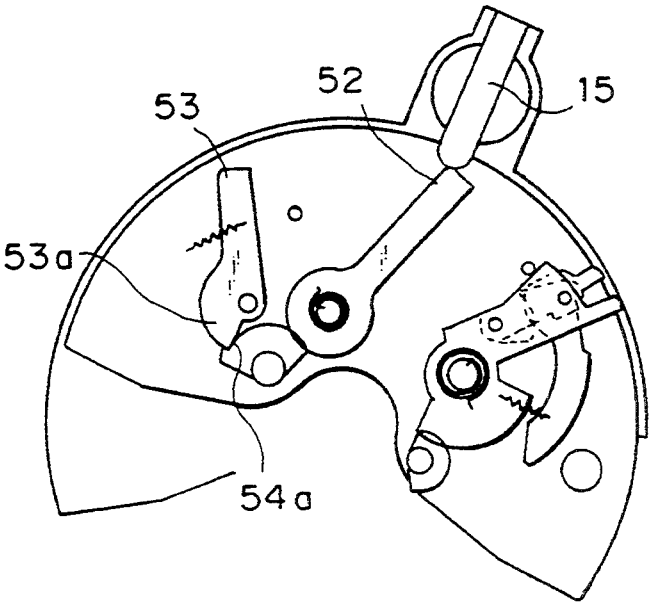
Figure 13A:
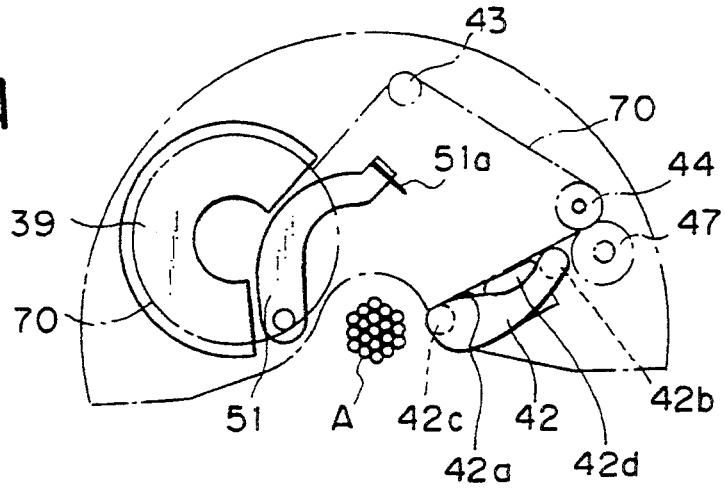
FIGS. 13A to 13G are perspective views showing, respectively, the rear sides of FIGS. 12A to 12G.
Figure 13B:
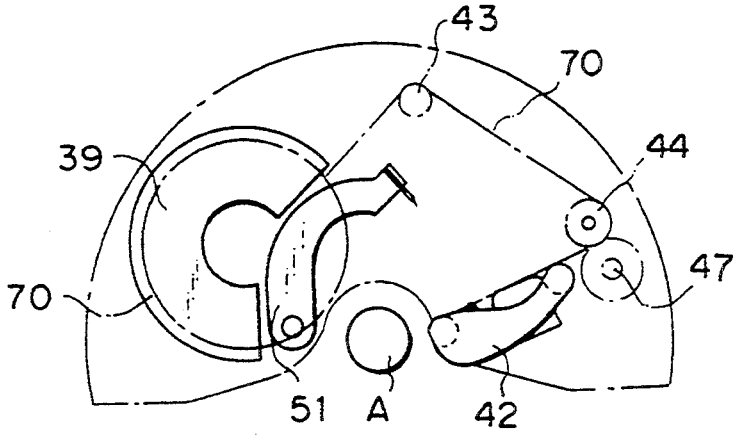
Figure 13C:
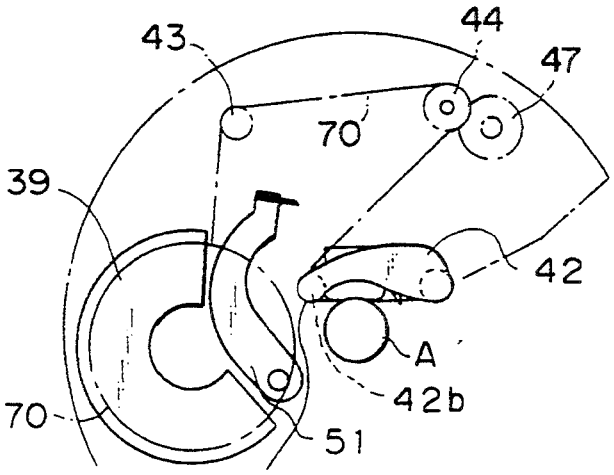
Figure 13D:
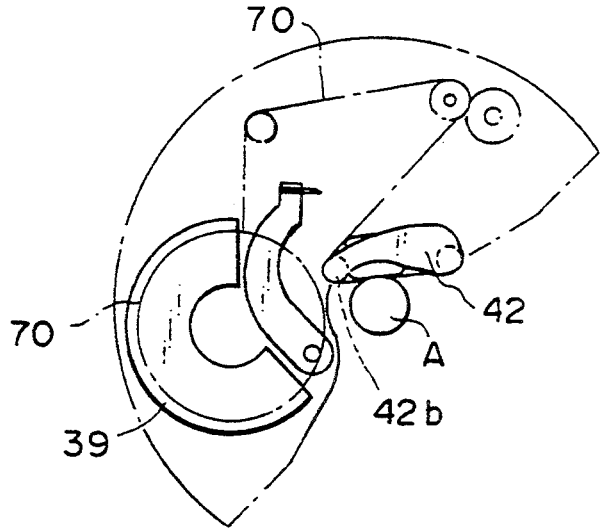
Figure 13E:
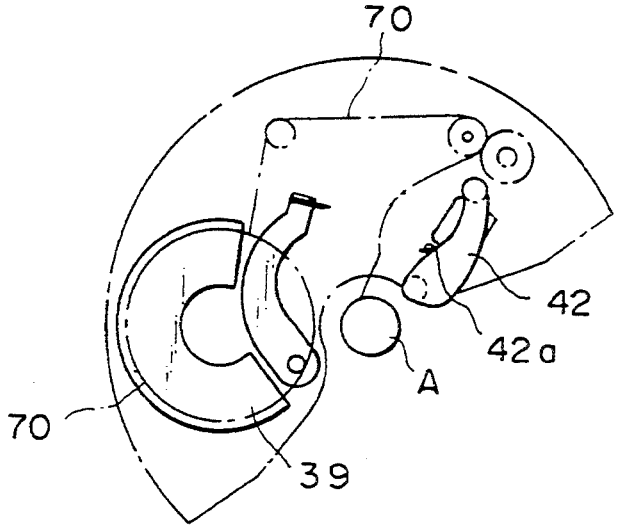
Figure 13F:
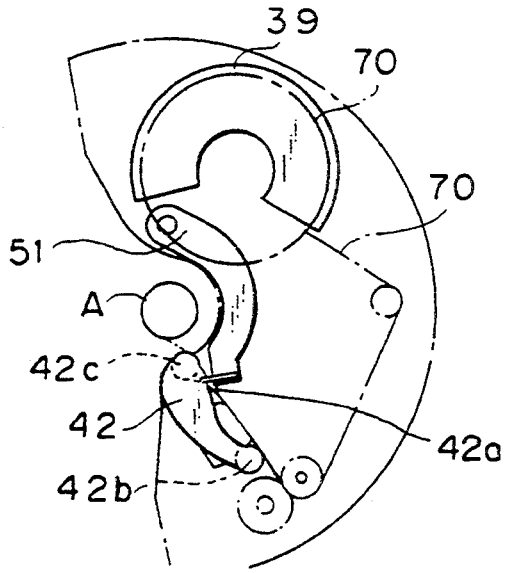
Figure 13G:
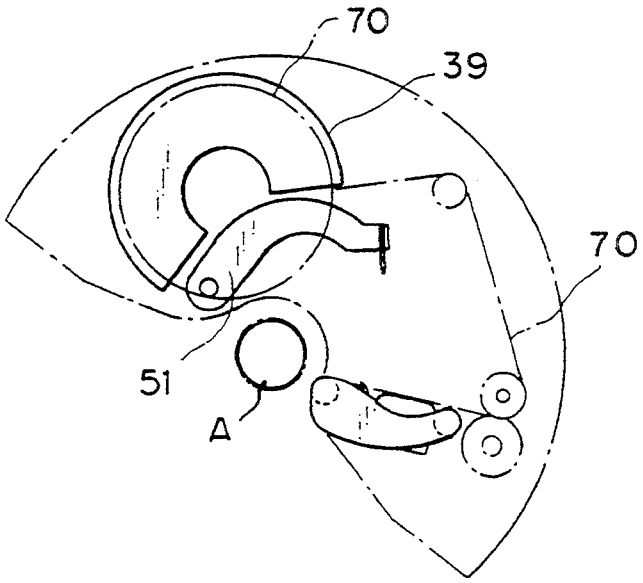
Figure 14:
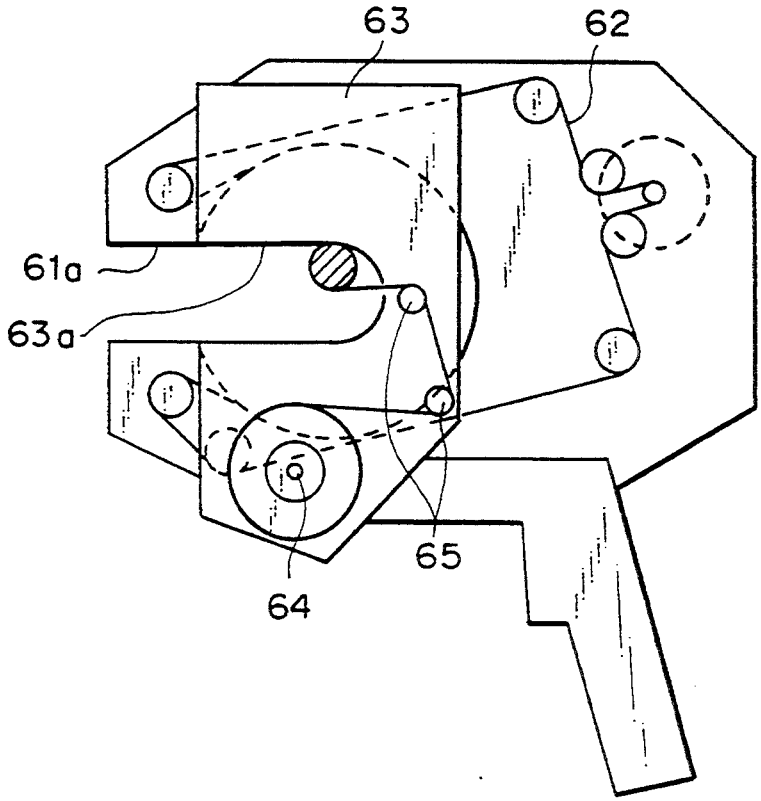
Fig. 14 PRIOR ART
FIG. 14 is a front view of a conventional tape winding device.
Figure 15A:
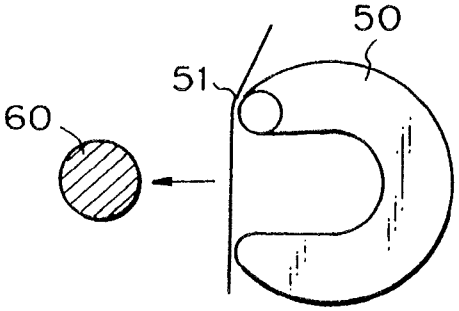
Fig. 15A PRIOR ART
FIG. 15 is an explanatory view showing the tape-winding operations of the conventional device.
Figure 15B:
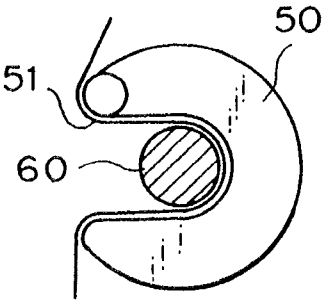
Fig. 15B PRIOR ART
Figure 15C:
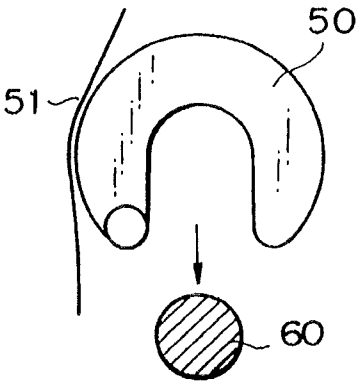
Fig. 15C PRIOR ART

As shown in FIGS. 12A, 13A, a wiring harness is set, and in a state in which the lever 15 is situated between the return lever 52 and the driving lever 41 when the rotating plate 30 is slowly rotated with the lever 15 being caused to approach the rotating plate 30, as shown in B, the set lever 41*a* is pressed to rotate with the set gear 41*c*, whereby the set gear 41*c* rotates to a position where it is brought into mesh engagement with the interlock gear 47. In this stage, as shown in A and B, the feeding arm 42 does not move.

Following this, when the rotating plate 30 rotates, as shown in C, the driving lever 41 as well as the set lever 41*a* are pressed to rotate, and the interlock gears 45, 46 simultaneously rotate.

Since this rotates the feeding arm 42, the projection 42*b* of the feeding arm 42 catches the adhesive-backed tape 70 so as to feed out the same, and as shown in C the feeding arm 42 presses the adhesive side of the adhesive-backed tape 70 against the outer circumferential surface of the wiring harness A. Since the guide roller 44 rotates in synchronism with the above movement of the feeding arm, feeding-out of the tape can easily be carried out.

Furthermore, when the rotating plate 30 rotates, as shown in D, the set lever is first released from the lever 15, and the set lever 41*a* is restored to its initial position by means of the coil spring 41*e*. Then, as shown in E, when the driving lever 41 is released from the lever 15, the feeding arm 42 together with the driving lever 41 is restored to its initial position by virtue of the biasing force of the spiral spring 41*f*. At this time, since the adhesive side of the adhesive-backed tape 70 adheres to the outer circumferential surface of the wiring harness A, the adhesive-backed tape naturally comes off the support pin 42*a*.

In this state, when withdrawing the lever 15 from the rotating plate 30, and rotating the rotating plate 30 at high speed, the adhesive-backed tape 70 is wound around the wiring harness A.

When completing the winding of the adhesive-backed tape 70, the number of revolutions of the rotating plate 30 is decreased, and the lever 15 is caused to approach the rotating plate 30 before the lock lever 53. Then, as shown in F, the lock lever 53 is pressed, and the locking projection 53*a* thereof comes off the cam 54*a*, causing the cutter arm 51 to rotate so as to cut the adhesive-backed tape 70 between the projection 42*c* and the support pin 42*a* of the feeding arm 42. At this time, since the adhesive-backed tape 70 is forced into a space between the projection 42*c* and the support pin 42*a*, the leading end of the adhesive-backed tape so cut that is on the side of the device is naturally put through the support pin 42*a*.

When the rotating plate 30 further rotates, as shown in G, the return lever 52 is pressed, and the cutter arm 51 rotates to its initial position, whereby the locking projection 53*a* of the lock lever 53 is brought into engagement with the cam 54*a* again, the device is restored to its initial state in which another tape-winding cycle is ready.

Since the tape winding device of the present invention is constructed as described above, it is possible to increase the central angle of the notched portions formed, respectively, in the rotating plate and the device main body to about 150°.

Due to this construction, when winding a branched portion of a bundle of wires, it is possible to easily pass through such a branched portion only by tilting the tape winding device, and this obviates the necessity of carrying out conventional laborious work of cutting and rewinding an adhesive-backed tape every time a branched portion is encountered, resulting in improved workability.

Furthermore, with the tape winding device according to the present invention, once a tape is set, a tape-winding operation can continue to be carried out until the tape comes to an end only by operating the respective levers. obviating the necessity of the operator's touching the tape.

Consequently, it is not necessary to carry out laborious work of adhesively contacting the leading end of a tape to a body around which the tape is wound every time a tape is started to be wound, as is often the case with a conventional tape winding device, resulting in improved working efficiency.

In addition, since the leading end of an adhesive-backed tape is put through the support pin to be held thereon, it is possible to start winding a tape around a bundle of wires at any angle relative to the bundle of wires.

What is claimed is:

1. A method of winding sheathing tape around an object comprising the steps of pulling out an adhesive-backed tape mounted in a rolled fashion on a rotating plate designed to rotate around the periphery of the object, leading said tape to a feeding arm which is pivotally supported about a fulcrum point on said rotating plate, causing a support pin on said feeding arm provided in the vicinity of the fulcrum point to penetrate through the leading end portion of said tape to support said leading end portion, pivoting said feeding arm so that a projection provided on the distal end of said feeding arm presses against said tape so as to press the portion of said tape between said projection and said support pin against the outer circumferential surface of the object, thereafter restoring said arm to its initial position so as to withdraw said support pin from the leading end portion of said tape, rotating said rotating plate for winding said tape around the object, slowing down said rotating plate when the winding of said tape is completed, and pivoting a cutter arm which is pivotally supported on said rotating plate so that a blade portion of said cutter arm enters between said support pin and a projection provided on said feeding arm near said fulcrum point so that the leading end portion of said tape is cut off by said blade portion and the resultant leading end of said tape is automatically pressed onto said support pin by said blade portion.

* * * * *